US007441935B2

(12) United States Patent
Kim

(10) Patent No.: US 7,441,935 B2
(45) Date of Patent: Oct. 28, 2008

(54) BACKLIGHT UNIT, DISPLAY APPARATUS COMPRISING THE SAME AND CONTROL METHOD THEREOF

(75) Inventor: Young-kook Kim, Suwon-si (KR)

(73) Assignee: Samsung Electronics Co., Ltd, Suwon-si (KR)

( * ) Notice: Subject to any disclaimer, the term of this patent is extended or adjusted under 35 U.S.C. 154(b) by 59 days.

(21) Appl. No.: 11/491,920

(22) Filed: Jul. 25, 2006

(65) Prior Publication Data

US 2007/0030697 A1 Feb. 8, 2007

(30) Foreign Application Priority Data

Aug. 5, 2005 (KR) ..... 10-2005-0071937

(51) Int. Cl.
*F21V 7/04* (2006.01)

(52) U.S. Cl. ..... 362/613; 362/97; 362/276

(58) Field of Classification Search ..... 362/97, 362/612, 276, 613, 802, 225, 29; 315/307, 315/318

See application file for complete search history.

(56) References Cited

U.S. PATENT DOCUMENTS

| | | | | |
|---|---|---|---|---|
| 6,452,582 | B1 | 9/2002 | Rolston | |
| 7,158,173 | B2 * | 1/2007 | Lee et al. | 348/222.1 |
| 2001/0008395 | A1 * | 7/2001 | Yamamoto et al. | 345/102 |
| 2003/0230991 | A1 * | 12/2003 | Muthu et al. | 315/307 |
| 2004/0113044 | A1 | 6/2004 | Ishiguchi | |
| 2004/0257318 | A1 * | 12/2004 | Itoh | 345/87 |
| 2005/0058450 | A1 * | 3/2005 | Yamamoto et al. | 398/25 |
| 2005/0162737 | A1 | 7/2005 | Whitehead et al. | |

FOREIGN PATENT DOCUMENTS

| | | |
|---|---|---|
| EP | 0 026 454 | 4/1981 |
| JP | 2002-082326 | 3/2002 |
| JP | 2005-208486 | 8/2005 |
| KR | 10-2004-0061281 | 7/2004 |
| KR | 2004-96186 | 11/2004 |
| KR | 2005-73518 | 7/2005 |
| WO | WO 02/076150 | 9/2002 |
| WO | WO 03-021565 | 3/2003 |
| WO | WO 2004/074918 | 9/2004 |

OTHER PUBLICATIONS

KR Office Action dated Nov. 7, 2006 issued in KR 2005-71937.
European Search Report dated Aug. 29, 2007 issued in EP 06118446.
Chinese Office Action dated Oct. 19, 2007 issued in CN 200610151337.8.

* cited by examiner

*Primary Examiner*—Ali Alavi
(74) *Attorney, Agent, or Firm*—Stanzione & Kim, LLP

(57) ABSTRACT

A display apparatus including a liquid crystal display (LCD) panel, a light source unit including a plurality of point light sources to provide light to the LCD panel and divided into a plurality of light source areas, a plurality of light source driving parts to supply electric power to the plurality of light source areas, a brightness sensor to sense a brightness of the light source unit, and a light source controller to control the light source driving part based on the brightness sensed by the brightness sensor so that the light source unit provides light of uniform brightness.

29 Claims, 3 Drawing Sheets

BACKLIGHT UNIT, DISPLAY APPARATUS COMPRISING THE SAME AND CONTROL METHOD THEREOF

CROSS-REFERENCE TO RELATED APPLICATIONS

This application claims priority under 35 U.S.C. §119(a) from Korean Patent Application No. 2005-0071937, filed on Aug. 5, 2005, in the Korean Intellectual Property Office, which is hereby incorporated by reference in its entirety.

BACKGROUND OF THE INVENTION

1. Field of the Invention

The present general inventive concept relates to a backlight unit, a display apparatus comprising the same, and a control method thereof, and more particularly, to a backlight unit, a display apparatus comprising the same, and a control method thereof to control a light source unit that is divided into a plurality of areas.

2. Description of the Related Art

Recently, a flat display device, such as a liquid crystal display (LCD), a plasma display panel (PDP) and an organic light emitting diode (OLED), has been developed as an alternative to a CRT.

An LCD comprises an LCD panel that comprises a thin film transistor (TFT) substrate, a color filter substrate, and liquid crystals interposed between both substrates. The LCD panel does not emit light by itself, thus there is disposed a backlight unit in the rear of the TFT substrate to provide light. Transmittance of the light irradiated from the backlight unit is adjusted according to the alignment of the liquid crystals. The LCD panel and the backlight unit are accommodated in a chassis.

The backlight unit is either an edge type backlight unit or a direct type backlight unit according to a position of a light source.

In the edge type backlight unit, a light source is installed on a side of a light guiding plate. The edge type backlight unit is typically used with a small LCD device, such as a monitor for a laptop computer and a monitor for a desktop computer. The edge type backlight unit has various advantages, such as high uniformity of light and a long life. Furthermore, an LCD that uses the edge type backlight unit may be thinner.

The direct type backlight unit has been developed along with the development of a large-screen LCD. In the direct type backlight unit, a plurality of light sources are disposed under the LCD panel and directly emit light to the surface of the LCD panel. The direct type backlight unit uses the available light sources more than the edge type backlight unit. Therefore, the direct type backlight unit obtains a higher brightness; however, the brightness is not uniform.

In a conventional backlight unit where an entire light source is driven by one driving part, the entire light source should be replaced with a new one when the brightness is not uniform. In this case, it costs a lot of money to replace the light source with a new one and the above-mentioned problem repeatedly arises.

SUMMARY OF THE INVENTION

The present general inventive concept provides for a backlight unit, a display apparatus comprising the same, and a control method thereof to adjust a brightness and a color temperature by light source units.

Additional aspects and advantages of the present general inventive concept will be set forth in part in the description which follows and, in part, will be obvious from the description, or may be learned by practice of the general inventive concept.

The foregoing and/or other aspects and utilities of the present general inventive concept may be achieved by providing a display apparatus, comprising a liquid crystal display panel, a light source unit comprising a plurality of point light sources to provide light to the liquid crystal display panel and divided into a plurality of-light source areas, a plurality of light source driving parts to supply electric power to corresponding ones of the plurality of light source areas, a brightness sensor to sense a brightness of the light source unit, and a light source controller to control the plurality of light source driving parts based on the brightness sensed by the brightness sensor so that the light source unit provides light of uniform brightness.

The brightness sensor may sense an actual brightness of each of the plurality of light source areas.

The display apparatus may further comprise a brightness calculator to calculate an average brightness using each actual brightness of the plurality of light source areas sensed by the brightness sensor, and to calculate a difference between the average brightness and each actual brightness of the light source areas.

The light source controller may control the light source driving part to supply additional electric power to one or more of the plurality of light source areas when the difference between the average brightness and an actual brightness of the one or more of the plurality of the light source areas is out of a predetermined permissible range.

The plurality of point light sources may emit a red color, a green color, and a blue color, respectively.

The plurality of light source driving parts may supply electric power by emitting colors of the point light source.

The foregoing and/or other aspects and utilities of the present general inventive concept may also be achieved by providing a backlight unit, comprising a light source unit comprising a plurality of point light sources and divided into a plurality of light source areas, a plurality of light source driving parts to supply electric power to corresponding ones of the plurality of light source areas, a brightness sensor to sense a brightness of the light source unit, and a light source controller to control the light source driving part based on the brightness sensed by the brightness sensor so that the light source unit provides light of uniform brightness.

The brightness sensor may sense an actual brightness of each of the plurality of light source areas.

The backlight unit may further comprise a brightness calculator to calculate an average brightness using each actual brightness of the plurality of light source areas sensed by the brightness sensor and to calculate a difference between the average brightness and each actual brightness of the plurality of light source areas.

The light source controller may control the light source driving part to supply additional electric power to one or more of the plurality of light source areas when the difference between the average brightness and an actual brightness of the one or more of the plurality of light source areas is out of a predetermined permissible range.

The foregoing and/or other aspects and utilities of the present general inventive concept may also be achieved by providing a control method of a display apparatus, comprising providing an LCD panel, a light source unit comprising a plurality of point light sources to provide light to the LCD panel and divided into a plurality of light source areas, a plurality of light source driving parts to supply electric power to corresponding ones of the plurality of light source areas, and a brightness sensor to sense a brightness of the light source unit, sensing an actual brightness of each of the plurality of light source areas, and supplying light of uniform brightness based on the sensed brightness.

The control method of the display apparatus may further comprise calculating an average brightness of brightnesses by the light source areas; and calculating difference between the average brightness and the brightnesses by the light source areas.

The supplying of the light may supply additional electric power to one or more of the plurality of light source areas when the difference between the average brightness and an actual brightness of the one or more of the plurality of light source areas is out of a predetermined permissible range.

The foregoing and/or other aspects and utilities of the present general inventive concept may also be achieved by providing a backlighting unit to transmit light to an image display device, comprising a light source unit comprising a plurality of light source areas each having light sources thereon to emit light, a plurality of brightness sensors located on corresponding ones of the plurality of light source areas to determine an actual brightness of each of the plurality of light source areas, and a power supply control unit to control an amount of power supplied to each of the light source areas independently based on the determined actual brightness.

Each of the plurality of light source areas may comprise at least one of the plurality of brightness sensors, and at least one of the plurality of light sources. Each of the plurality of light source areas may comprise a single brightness sensor, and two or more light sources. Each of the plurality of brightness sensors may comprise a converting unit to convert light data corresponding to the actual brightness of each of the plurality of light source areas into an electric signal. Each of the plurality of brightness sensors may be located in a middle of corresponding ones of the plurality of light source areas. The power supply control unit may comprise a plurality of driving parts to drive corresponding ones of the plurality of light source areas, a brightness calculator to determine an average brightness of the light source unit and to calculate differences between the average brightness and each actual brightness of the plurality of light source areas, and a controller to receive brightness data from the brightness calculator corresponding to the differences and to control the plurality of driving parts based on the brightness data.

The foregoing and/or other aspects and utilities of the present general inventive concept may also be achieved by providing an image display apparatus, comprising an image display panel, a light source unit comprising a first light source area, a first plurality of light sources located on the first light source area, and a first brightness sensor located on the first light source area to determine an actual brightness of the first light source area, a first driving part to supply electric power to the first light source area to drive the first light source area, a brightness calculator to determine an average brightness of the light source unit and to calculate a difference between the average brightness and the actual brightness of the first light source area, and a controller to receive first brightness data from the brightness calculator corresponding to the difference between the average brightness and the actual brightness of the first light source area and to control the first driving part based on the first brightness data.

The controller may control the first driving part to increase an amount of electric power supplied to the first light source area when the difference between the average brightness and the actual brightness of the first light source area is outside of a predetermined range of values, and the controller may control the first driving part to maintain an amount of electric power supplied to the first light source area when the difference between the average brightness and the actual brightness of the first light source area is within a predetermined range of values, inclusive of end values of the range. The image display apparatus may further comprise a second light source area on the light source unit, a second plurality of light sources located on the second light source area, a second brightness sensor located on the second light source area to determine an actual brightness of the second light source area, and a second driving part to supply electric power to the second light source area to drive the second light source area, wherein the brightness calculator further calculates a difference between the average brightness and the actual brightness of the second light source area, and the controller receives second brightness data from the brightness calculator corresponding to the difference between the average brightness and the actual brightness of the second light source area and controls the second driving part based on the second brightness data.

The foregoing and/or other aspects and utilities of the present general inventive concept may also be achieved by providing a method of controlling a backlighting unit comprising a light source unit comprising first and second light source areas, first and second pluralities of light sources respectively located on the first and second light source areas, and first and second brightness sensors respectively located on the first and second light source areas to determine an actual brightness of the first and second light source areas, the method comprising determining an average brightness of the light source unit, calculating a difference between the average brightness and the actual brightness of the first light source area, and controlling a supply of electric power to the first light source area based on first brightness data corresponding to the difference between the average brightness and the actual brightness of the first light source area.

The method may further comprise increasing an amount of electric power supplied to the first light source area when the difference between the average brightness and the actual brightness of the first light source area is outside of a predetermined range of values, and maintaining an amount of electric power supplied to the first light source area when the difference between the average brightness and the actual brightness of the first light source area is within a predetermined range of values, inclusive of end values of the range. The method may further comprise calculating a difference between the average brightness and the actual brightness of the second light source area, and controlling a supply of electric power to the second light source area based on second brightness data corresponding to the difference between the average brightness and the actual brightness of the second light source area.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
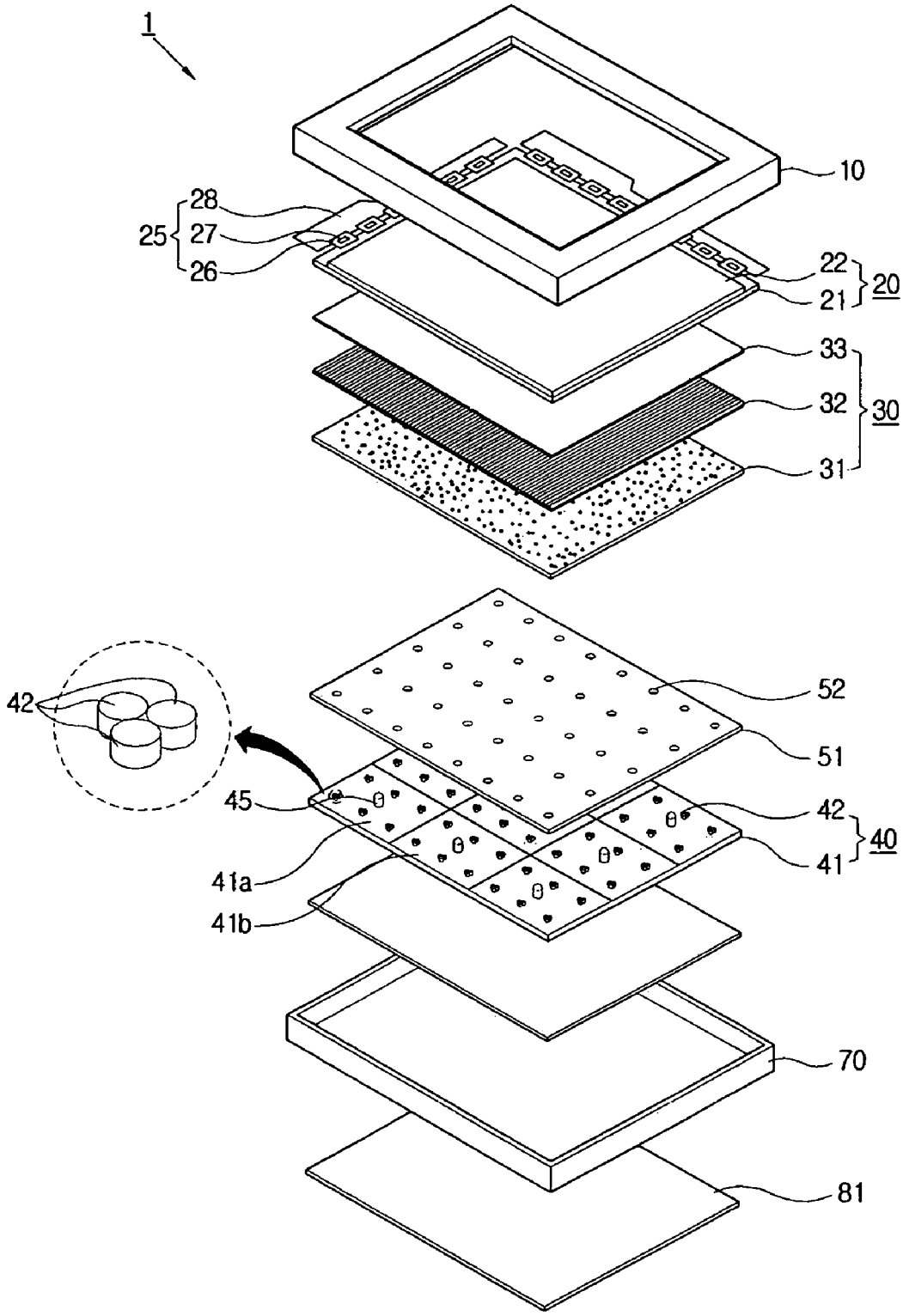
FIG. 1 is an exploded perspective view illustrating a display apparatus according to an embodiment of the general inventive concept.

Reference will now be made in detail to the embodiments of the present general inventive concept, examples of which are illustrated in the accompanying drawings, wherein like reference numerals refer to like elements throughout. The embodiments are described below so as to explain the present general inventive concept by referring to the figures.

Below, a point light source will be described with a light emitting diode (LED) as an example. However, the present general inventive concept is not limited to the point light source being an LED. Other point light sources incorporated into the LCDs described herein would also be within the scope of the present general inventive concept.

As illustrated in FIG. 1, a display apparatus 1 can comprise an LCD panel 20, a light control member 30, and a light source unit 40, which are disposed in a rear of the LCD panel 20. The light source unit 40 can be disposed in a rear of the light control member 30 and can comprise an LED 42 and an LED board 41 where the LED 42 is seated.

The LCD panel 20, the light control member 30, and the LED circuit board 41 can be accommodated in an upper cover 10 and a lower cover 70.

The LCD panel 20 can comprise a TFT substrate 21 where TFTs are formed, a color filter substrate 22 which faces the TFT substrate 21, a sealant (not illustrated) adhering both of the substrates 21 and 22 together and forming a cell gap, and a liquid crystal layer (not illustrated) disposed between the substrate 21, the substrate 22, and the sealant. As illustrated in FIG. 1, the LCD panel 20 can have a rectangular shape having a long side and a short side. However, the present general inventive concept is not limited to the LCD panel 20 having the rectangular shape.

The LCD panel 20 adjusts an alignment of the liquid crystal layer to form an image. However, the LCD panel 20 does not emit light by itself. Thus there is provided the LED 42 in the rear of the LCD panel 20 to provide light to the LCD panel 20. A driving part 25 can be provided in one side of the TFT substrate 21 to provide a driving signal. The driving part 25 can comprise a flexible printed circuit (FPC) 26, a driving chip 27 mounted on the FPC 26 and a printed circuit board (PCB) 28 connected to one side of the FPC 26. The driving part 25 illustrated in FIG. 1 is a chip on film (COF) type driving part. However, any suitable driving part type, such as tape carrier package (TCP), chip on glass (COG), or the like, can be used as the driving part. Also, the driving part 25 may be formed on the TFT substrate 21, forming a wire line.

The light control member 30 disposed in the rear of the LCD panel 20 can comprise a diffusion plate 31, a prism film 32, and a protection film 33.

The diffusion plate 31 can comprise a base plate and a coating layer having beads formed on the base plate. The diffusion plate 31 diffuses light from the LED 42, thereby improving brightness uniformity.

The prism film 32 can comprise triangular prisms formed in a predetermined alignment thereon. The prism film 32 concentrates the light diffused from the diffusion plate 31 perpendicularly to a surface of the LCD panel 20. Two prism films 32 can be used and micro prisms formed on each of the prism films 32 make a predetermined angle with each other. The light passing through the prism film 32 mostly continues vertically, thereby forming a uniform brightness distribution. A reflective polarizing film may be used along with the prism film 32, or only the reflective polarizing film may be used without the prism film 32.

The light source unit 40 to provide light to the LCD panel 20 can comprise a plurality of LEDs 42 and the LED board 41 where the LEDs 42 are seated. The LED board 41 can be disposed across the rear of the LCD panel 20 and can be divided into a plurality of light source areas 41*a* and 41*b*, each comprising a plurality of LEDs 42.

In embodiments of the present general inventive concept, the light source unit 40 can be divided into nine light source areas, each of the light source areas comprising six LEDs 42 and one brightness sensor 45. Each of the light source areas can be provided with electric power from a separate light source driving part (not illustrated). The light source driving part and a light source controller to control the light source driving part can be provided in the rear of the LED board 41.

The LEDs 42 can be seated in the LED board 41 and can be disposed across the rear of the LCD panel 20. The LEDs 42 can comprise a red LED 42, a green LED 42, and a blue LED 42, and the light emitted by the LEDs 42 can be mixed to provide a white color light to the LCD panel 20. However, the present general inventive concept is not limited to the arrangement of the LEDs 42 illustrated in FIG. 1. Also, a white LED 42 may be provided instead of the red, the green, and the blue LEDs 42.

The brightness sensor 45 can be disposed at a location that is about the center of the light source area, and the brightness sensor 45 senses a brightness of light emitted from the LED 42. An entire brightness and color temperature can be adjusted by dividing the light source unit 40 into a plurality of areas, and thus information on brightnesses in the respective light source areas is needed. Accordingly, the brightness sensor 45 can be disposed in each of the light source areas, thereby providing information on each light source area to the light source controller. The information transmitted from the brightness sensor 45 can be used as a data to calculate an average brightness of the LCD panel 20.

The brightness sensor 45 can comprise a circuitry element comprising a light-receiving diode and has a mechanism that converts received light into an electrical signal, such as an electric current.

A reflecting plate 51 can be disposed on a portion of the LED board 41 where the LEDs 42 are not seated. LED through holes 52 can be disposed in the reflecting plate 51 corresponding to an arrangement of the LEDs 42 so that the LEDs 42 are accommodated in the LED through holes 52. The reflecting plate 51 reflects light that is incident downward and provides the reflected light to the diffusion plate 31. The reflecting plate 51 may comprise polyethylene terephthalate (PET) or polycarbonate (PC). Further, the reflecting plate 51 is formed thick enough not to shrink due to heat generated from the LED 42.

A thermal conductive sheet 81 adheres to an external surface of the lower cover 70. The thermal conductive sheet 81 can be disposed parallel to the LED board 41, and the thermal conductive sheet 81 radiates the heat generated from the LED 42 external to the display apparatus 1. The thermal conductive sheet 81 has two different thermal conductivities depending on a surface direction or a thickness direction. The thermal conductivity of the thermal conductive sheet 81 in the surface direction may be about 100 W/mK higher than in the thickness direction.

Figure 2:
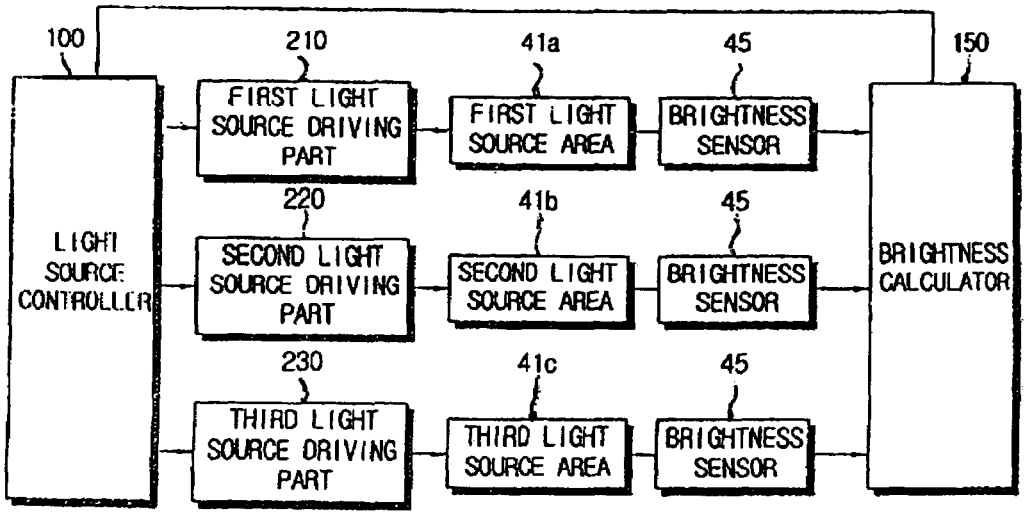
FIG. 2 is a control block diagram illustrating a backlight unit of the display apparatus in FIG. 1 according to an embodiment of the general inventive concept.

As illustrated in FIGS. 1 and 2, a backlight unit according to an embodiment of the present general inventive concept can comprise a plurality of light source areas 41*a*, 41*b*, and 41*c*, each comprising LEDs 42, a plurality of light source driving parts 210, 220, and 230 to provide electric power to corresponding ones of the plurality of light source areas 41*a*, 41*b*, and 41*c*, a plurality of brightness sensors 45 to sense a brightness in corresponding ones of the plurality of light source areas 41*a*, 41*b*, and 41*c*, a brightness calculator 150 to calculate an average brightness, and a light source controller 100 to control the backlight unit.

The brightness calculator 150 calculates an average brightness of the light source areas 41*a*, 41*b*, and 41*c* based on an actual brightness of the light source areas 41*a*, 41*b*, and 41*c* sensed by the brightness sensor 45. Also, the brightness calculator 150 calculates differences between the average brightness and each actual brightness of the respective light source areas 41*a*, 41*b*, and 41*c*, and provides the differences to the light source controller 100. In particular, the brightness sensor 45 senses the actual brightness of each of the light source areas 41*a*, 41*b*, and 41*c*, the brightness calculator 150 determines which area of brightness is different from the average brightness, calculates the difference, and processes the difference into a data that the light controller 100 can use. An algorithm to calculate an average brightness and a variation of brightness follows a conventional logic, and thus is omitted in this description.

The brightness calculator 150 together with the light source controller 100 may be provided in a single chip, and the brightness calculator 150 may be comprised in logics of the light source controller 100.

The plurality of light source driving parts 210, 220, and 230 supply electric power to the corresponding light source areas 41*a*, 41*b*, and 41*c* independently according to the colors of LED 42, i.e. according to the red, blue, and green LEDs 42 seated on the light source areas 41*a*, 41*b*, and 41*c*. The amount of electric power supplied to the respective LEDs 42 is controlled by the light source controller 100.

LEDs 42 emitting the same color are connected to each other in series. The light source driving parts 210, 220, and 230 can comprise switching elements to provide electric power to the LEDs 42 connected in series and comparators to adjust the amount of electric power provided to the LEDs 42 connected in series. When the light source driving parts 210, 220, and 230 receive a control signal regarding the amount of electric power to as supplied from the light source controller 100, the light source driving parts 210, 220, and 230 adjust a duty ratio of the switching element, thereby adjusting the supply amount of electric power. Thus, the light source unit 40 can be divided into a plurality of light areas and the light source controller 100 can adjust the LEDs 42 by colors so as to control the respective light areas independently.

The light source controller 100 controls the light source driving parts 210, 220, and 230 based on data on an average brightness and a variation of brightness in the light source areas 41*a*, 41*b*, and 41*c* received from the brightness calculator 150 so that the light source unit 40 provides light of uniform brightness. The light source controller 100 controls the light source driving parts 210, 220, and 230 to supply additional electric power to one or more of the light source areas 41*a*, 41*b*, and 41*c* where the brightness is low, that is, where a difference between the average brightness of the light areas and an actual brightness of one or more of the respective light source areas 41*a*, 41*b*, and 41*c* are out of a predetermined permissible range. That is, the light source controller 100 adjusts the light source driving parts 210, 220, and 230 independently so as to supply the electric power to the light source area 41*a*, 41*b*, and/or 41*c* where the brightness decreases below the average brightness. The electric power adjusted by the light source driving parts 210, 220, and 230 can be an electric current that is supplied to the LED 42.

In various embodiments of the present general inventive concept, an external apparatus, such as a computer main body, may re-apply the control signal to the backlight unit based on the brightness information of the backlight unit. In this case, the computer main body is connected to the display apparatus 1 through a communicating line transmitting and/or receiving the control signal between the computer main body and the display apparatus 1. A user applying the control signal may change the control signal as desired.

Figure 3:
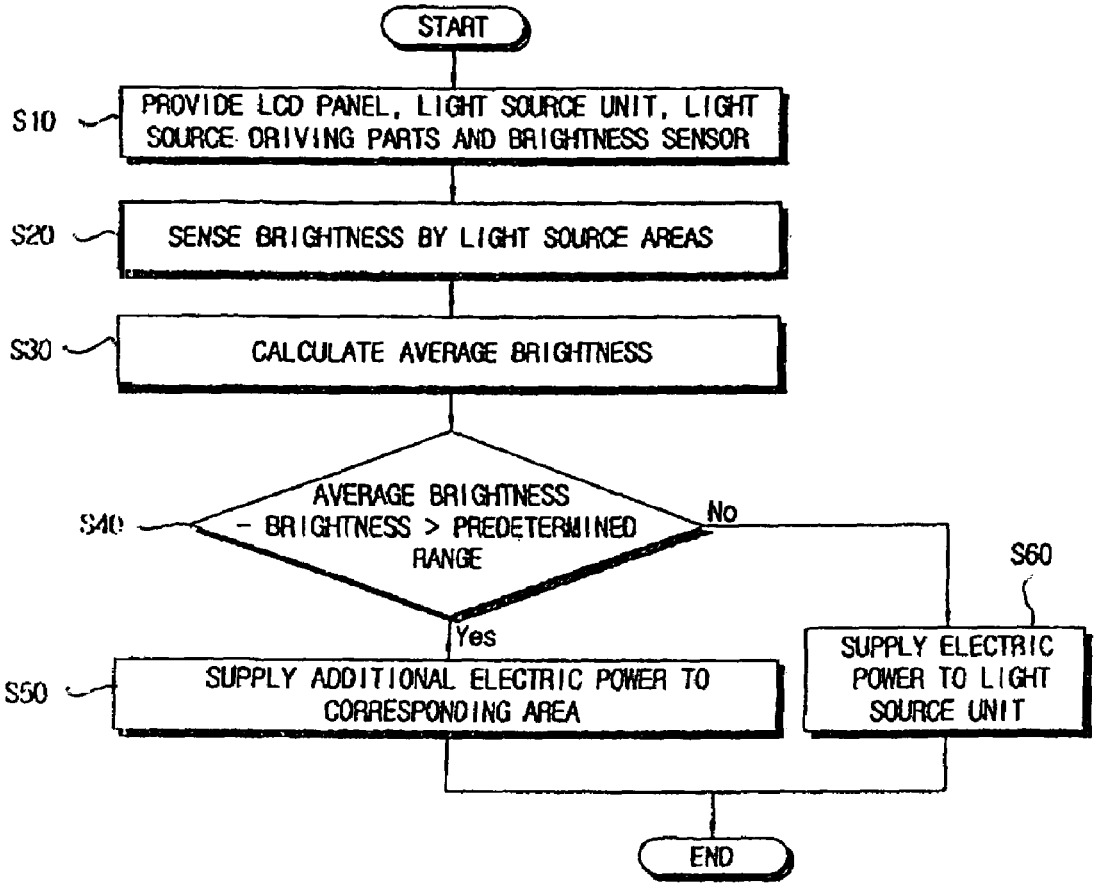
FIG. 3 is a flow chart illustrating a control method of the display apparatus of FIG. 1 according to an embodiment of the general inventive concept.

FIG. 3 is a flow chart illustrating a control method of a display apparatus according to the embodiment of the general inventive concept.

Referring to FIGS. 1-3, there are provided the LCD panel 20, the light source unit 40 comprising the plurality of LEDs 42 and divided into the plurality of light source areas 41*a*, 41*b*, and 41*c*, the plurality of light source driving parts 210, 220, and 230 to supply electric power to the plurality of light source areas 41*a*, 41*b*, and 41*c* independently, and the brightness sensor 45 to sense the brightness of the light source unit 40 at operation S10.

Then, the brightness sensor 45 senses brightness by the respective light source areas 41*a*, 41*b*, and 41*c* at operation S20. The brightness sensed by the brightness sensor 45 is input to the brightness calculator 150. The brightness calculator 150 calculates an average brightness of the light source areas 41*a*, 41*b*, and 41*c* at operation S30. Thereafter, the brightness calculator 150 calculates differences between the average brightness and each actual brightness of the light source areas 41*a*, 41*b*, and 41*c* and provides the average brightness and each actual brightness to the light source controller 100.

The light source controller 100 determines whether the differences between the average brightness and each actual brightness of the light source areas 41*a*, 41*b*, and 41*c* are out of a predetermined permissible range at operation S40.

If one or more differences (i.e., the differences between the average brightness and each actual brightness) are out of the predetermined permissible range, additional electric power can be provided to the corresponding area of the light source areas 41*a*, 41*b*, and 41*c* at operation S50. Since each actual brightness of the light source areas 41*a*, 41*b*, and 41*c* can become decreased as the display apparatus 1 is used, the respective brightness of each of the light source areas 41*a*, 41*b*, and 41*c* can be less than the average brightness value. Accordingly, the light source controller 100 applies a control signal to increase the amount of electric power supplied to the light source driving parts 210, 220, and 230, so that the light source driving parts 210, 220, and 230 can supply additional electric power to the respective light source areas 41*a*, 41*b*, and 41*c*. Moreover, if one or more differences (i.e., the differences between the average brightness and each actual brightness) are in the predetermined permissible range, the light source driving parts 210, 220, and 230 supply normal electric power to the light source unit 40 at operation S60.

The display apparatus 1, such as an LCD, changes with respect to brightness of a light source and color temperature and has a non-uniform brightness of entire light source as it is used, thereby decreasing an image quality displayed on the LCD panel 20. Thus, in various embodiments of the present general inventive concept, the light source unit 40 can be divided into a plurality of areas to independently sense a brightness of each of the areas and to compare each sensed brightness with an average brightness, thereby independently improving brightness where there is problem in the actual brightness.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A display apparatus, comprising:

a liquid crystal display panel;

a light source unit comprising a plurality of point light sources to provide light to the liquid crystal display panel and divided into a plurality of light source areas;

a plurality of light source driving parts to supply electric power to corresponding ones of the plurality of light source areas;

a brightness sensor disposed on each light source area of the plurality of light source areas to sense a brightness of the light source unit; and a light source controller to control the plurality of light source driving parts based on the brightness sensed by the brightness sensor so that the light source unit provides light of uniform brightness.

2. The display apparatus according to claim 1, wherein the brightness sensor senses an actual brightness of each of the plurality of light source areas.

3. The display apparatus according to claim 2, further comprising:

a brightness calculator to calculate an average brightness using each actual brightness of the plurality of light source areas sensed by the brightness sensor, and to calculate a difference between the average brightness and each actual brightness of the light source areas.

4. The display apparatus according to claim 3, wherein the light source controller controls the light source driving part to supply additional electric power to one or more of the plurality of light source areas when the difference between the average brightness and an actual brightness of the one or more of the plurality of the light source areas is out of a predetermined permissible range.

5. The display apparatus according to claim 1, wherein the plurality of point light sources emits a red color, a green color, and a blue color, respectively.

6. The display apparatus according to claim 1, wherein the plurality of light source driving parts supply electric power by emitting colors of the point light source.

7. A backlight unit, comprising:

a light source unit comprising a plurality of point light sources and divided into a plurality of light source areas;

a plurality of light source driving parts to supply electric power to corresponding ones of the plurality of light source areas;

a brightness sensor disposed on each light source area of the plurality of light source areas to sense a brightness of the light source unit; and a light source controller to control the light source driving part based on the brightness sensed by the brightness sensor so that the light source unit provides light of uniform brightness.

8. The backlight unit according to claim 7, wherein the brightness sensor senses an actual brightness of each of the plurality of light source areas.

9. The backlight unit according to claim 8, further comprising:

a brightness calculator to calculate an average brightness using each actual brightness of the plurality of light source areas sensed by the brightness sensor, and to calculate a difference between the average brightness and each actual brightness of the plurality of light source areas.

10. The backlight unit according to claim 9, wherein the light source controller controls the light source driving part to supply additional electric power to one or more of the plurality of light source areas when the difference between the average brightness and an actual brightness of the one or more of the plurality of light source areas is out of a predetermined permissible range.

11. A control method of a display apparatus including an LCD panel, a light source unit comprising a plurality of point light sources to provide light to the LCD panel and divided into a plurality of light source areas, a plurality of light source driving parts to supply electric power to corresponding ones of the plurality of light source areas, and a brightness sensor disposed on each light source area of the plurality of light source areas to sense a brightness of the light source unit, the control method comprising:

sensing an actual brightness of each of the plurality of light source areas; and supplying light of uniform brightness based on the sensed brightness.

12. The control method according to claim 11, further comprising:

calculating an average brightness using each actual brightness of the plurality of light source areas; and calculating a difference between the average brightness and each actual brightness of the plurality of light source areas.

13. The control method according to claim 12, wherein the supplying light supplies additional electric power to one or more of the plurality of light source areas when the difference between the average brightness and an actual brightness of the one or more of the plurality of light source areas is out of a predetermined permissible range.

14. A backlighting unit to transmit light to an image display device, comprising:

a light source unit comprising a plurality of light source areas;

a plurality of brightness sensors located on corresponding areas of the plurality of light source areas to determine an actual brightness of each of the plurality of light source areas; and a power supply control unit to control an amount of power supplied to each of the light source areas independently based on the determined actual brightness.

15. The backlighting unit according to claim 14, wherein each of the plurality of light source areas comprises:

at least one of the plurality of brightness sensors; and at least one of the plurality of light sources.

16. The backlighting unit according to claim 14, wherein each of the plurality of light source areas comprises:

a single brightness sensor; and two or more light sources.

17. The backlighting unit according to claim 14, wherein:

each of the plurality of brightness sensors comprises a converting unit to convert light data corresponding to the actual brightness of each of the plurality of light source areas into an electric signal.

18. The backlighting unit according to claim 14, wherein:

each of the plurality of brightness sensors is located in a middle of corresponding ones of the plurality of light source areas.

19. The backlighting unit according to claim 14, wherein the power supply control unit comprises:

a plurality of driving parts to drive corresponding ones of the plurality of light source areas;

a brightness calculator to determine an average brightness of the light source unit and to calculate differences between the average brightness and each actual brightness of the plurality of light source areas; and a controller to receive brightness data from the brightness calculator corresponding to the differences and to control the plurality of driving parts based on the brightness data.

20. A method of controlling a backlighting unit comprising a light source unit comprising first and second light source areas, first and second pluralities of light sources respectively located on the first and second light source areas, and first and second brightness sensors respectively located on the first and second light source areas to determine an actual brightness of the first and second light source areas, the method comprising:

determining an average brightness of the light source unit;

calculating a difference between the average brightness and the actual brightness of the first light source area; and controlling a supply of electric power to the first light source area based on first brightness data corresponding to the difference between the average brightness and the actual brightness of the first light source area.

21. The method according to claim 20, further comprising:

increasing an amount of electric power supplied to the first light source area when the difference between the average brightness and the actual brightness of the first light source area is outside of a predetermined range of values; and maintaining an amount of electric power supplied to the first light source area when the difference between the average brightness and the actual brightness of the first light source area is within a predetermined range of values, inclusive of end values of the range.

22. The method according to claim 20, further comprising:

calculating a difference between the average brightness and the actual brightness of the second light source area; and controlling a supply of electric power to the second light source area based on second brightness data corresponding to the difference between the average brightness and the actual brightness of the second light source area.

23. A direct type backlight unit, comprising:

a light source divided into a plurality of light source areas; and a brightness sensor disposed on each light source area of the plurality of light source areas, wherein the brightness sensor detects an actual brightness of a corresponding light source area.

24. A display apparatus, comprising:

a screen;

a light source unit which is divided into a plurality of light source areas, the light source unit comprising a plurality of LEDs;

a plurality of light source driving parts which supplies electric power to the light source unit;

a plurality of brightness sensors which senses a brightness of the light source unit; and a light source controller which controls the plurality of light source driving parts based on the brightness sensed by the brightness sensors;

wherein the screen is divided into a plurality of areas and the plurality of the light source areas provide light to the corresponding areas of the divided screen.

25. The display apparatus according to claim 24, wherein each of the plurality of brightness sensors senses the brightness of each of the light source area.

26. The display apparatus according to claim 25, wherein the plurality of brightness sensors are disposed on the light source unit.

27. The display apparatus according to claim 25, wherein the plurality of brightness sensors directly senses the brightness of the light source unit.

28. The display apparatus according to claim 24, wherein the plurality of the light source areas are controlled to have substantially same sensed brightness values.

29. A display apparatus, comprising:

a light source unit which is divided into a plurality of light source areas, the light source unit comprising a plurality of LEDs;

a plurality of light source driving parts which supplies electric power to the light source unit;

a plurality of brightness sensors which senses a brightness of the light source unit; and a light source controller to control the plurality of light source driving parts respectively based on the brightness sensed by the brightness sensors.

* * * * *